US005361599A

United States Patent [19]

Dasher

[11] Patent Number: 5,361,599

[45] Date of Patent: Nov. 8, 1994

[54] REFRIGERATOR SHELF LADDER FASTENER

[75] Inventor: James F. Dasher, Center Township, Vanderburgh County, Ind.

[73] Assignee: Whirlpool Corporation, Benton Harbor, Mich.

[21] Appl. No.: 89,450

[22] Filed: Jun. 28, 1993

[51] Int. Cl.[5] ..... F25D 11/00

[52] U.S. Cl. ..... 62/298; 312/407; 312/408

[58] Field of Search ..... 62/77, 298, 440; 312/214, 407, 408, 406

[56] References Cited

U.S. PATENT DOCUMENTS

| | | | |
|---|---|---|---|
| 2,139,244 | 12/1938 | Nauert | 62/298 |
| 2,620,255 | 12/1952 | Beckett | 312/408 |
| 2,741,525 | 4/1956 | Sywert | 312/408 |
| 3,707,317 | 12/1972 | Dawley et al. | 312/214 |
| 4,107,833 | 8/1978 | Knight et al. | 29/460 |
| 4,190,305 | 2/1980 | Knight et al. | 312/214 |
| 4,448,464 | 5/1984 | Reichert et al. | 312/214 |
| 4,462,645 | 7/1984 | Ballarin et al. | 312/408 |
| 4,823,978 | 4/1989 | Pufpaff | 220/307 |
| 5,004,302 | 4/1991 | Stocking et al. | 312/214 |
| 5,263,535 | 11/1993 | Philo et al. | 165/67 |

*Primary Examiner*—Henry A. Bennet
*Assistant Examiner*—William C. Doerrler
*Attorney, Agent, or Firm*—Thomas J. Roth; Stephen D. Krefman; Robert O. Rice

[57] ABSTRACT

A refrigeration apparatus cabinet includes an outer shell having walls defining a front opening. A plastic liner in the shell provides an insulation space therebetween and has connected rear and sidewalls to define a refrigerated space accessible through the shelf front opening. The liner includes a plurality of vertically spaced, aligned openings through one of the walls. An elongate reinforcement bar has a plurality of spaced, aligned openings, similar to the liner openings, the reinforcement bar being disposed behind the liner in the insulation space with each liner opening aligned with a reinforcement bar opening. A plurality of fasteners are provided, one for each liner opening. Each fastener comprises a head larger than the liner opening disposed within the refrigerated space and a tubular locking element extending rearwardly from the head, the locking element having an outer surface having an outer diameter less than the liner opening at its connection to the head and an outer diameter at a select position greater than that of the reinforcement bar openings, the select position being spaced a distance from the head corresponding to a combined thickness of the liner and the reinforcement bar. A locking element extends through each liner opening and the associated reinforcement bar opening so that the liner and reinforcement bar are sandwiched between the head and a select position to fasten the reinforcement bar to the liner. A body of in situ foam insulation is disposed in the insulation space, the fasteners preventing insulation from entering the refrigerated space.

19 Claims, 2 Drawing Sheets

REFRIGERATOR SHELF LADDER FASTENER

FIELD OF THE INVENTION

This invention relates to refrigeration apparatus cabinets and, more particularly, to a shelf ladder fastener.

BACKGROUND OF THE INVENTION

In the manufacture of refrigeration apparatus cabinets there is usually an outer shell of sheet metal and an inner liner of plastic and polyurethane insulation foamed in place between the inner liner and the outer shell. The liner includes connected walls to define a refrigerated storage space. Shelves and storage bins and the like are then selectively positioned within the storage space to provide efficient and maximum storage of articles to be refrigerated.

Within a product line of refrigerators, a manufacturer may use different styles of shelves and storage bins, as well as different configurations. Various methods of shelf installation have been used depending, in part, on whether the shelves are to be adjustable or fixed. Adjustable shelves typically employ shelf ladders fixedly secured to the liner for removably receiving shelf hooks. In a fixed shelf design, shelf supports may be fastened directly to one of the liner walls.

During the manufacturing process a liquid foam is deposited between the liner and shell. The foam expands and then hardens to fill the space. Any openings in the liner walls must be covered to prevent the liquid from escaping while it expands. The above-described shelf support systems typically achieve this by preinstalling any shelf supporting structure prior to the foaming process. Doing so requires that product differentiation be established at an early stage of manufacturing. Advantageously, a uniform cabinet design should be employed to provide economies of scale in manufacturing, with product differentiation being evident later in the assembly process. Particularly, a common cabinet design should be used from which products could be produced with shelf ladders, with several designs of shelf ladders possible, without shelf ladders, or with another method of shelf installation.

In refrigerator cabinets using shelf ladders, it is necessary to support the weight of the shelves as it is distributed from the shelf ladders to the liner. This is often done with a reinforcement bar in the foam insulation behind the liner. This requires that the reinforcement bar be installed prior to foam insulating the cabinet. It is also desirable to provide mounting points on a refrigerator liner for mounting structures besides shelf ladders, where reinforcement bars are not necessary.

The present invention is intended to solve one or more of the problems discussed above in a novel and simple manner.

SUMMARY OF THE INVENTION

In accordance with the invention there is disclosed a snap fit fastener for fastening a reinforcement bar to a refrigerator liner.

It is a feature of the invention that the fastener suitably covers any holes through the refrigerator liner.

It is another feature of the invention that the fastener is adapted for supporting a shelf ladder.

It is yet another feature of the invention that the fastener is adaptable for use on a refrigerator liner without use of a reinforcement bar.

Broadly, there is disclosed herein a refrigeration apparatus cabinet comprising an outer shell including walls defining a front opening. A plastic liner in the shell provides an insulation space therebetween and has connected rear and side walls to define a refrigerated space accessible through the shell front opening. The liner includes a plurality of openings through one of the walls. A reinforcement, one for each liner opening, comprises a plate having an opening, similar to the liner opening, the reinforcement being disposed behind the liner in the insulation space aligned with a liner opening. A plurality of fasteners are provided, one for each liner opening. Each fastener comprises a head larger than the liner opening disposed in the refrigerated space and a tubular locking element extending rearwardly from the head, the locking element having an outer surface having an outer diameter less than the liner opening at its connection to the head and an outer diameter at a select position greater than that of the reinforcement opening, the select position being spaced a distance from the head corresponding to a combined thickness of the liner and the reinforcement. A locking element extends through each liner opening and the associated reinforcement opening so that the liner and reinforcement are sandwiched between the head and the select position to fasten the reinforcement to the liner. A body of in situ foam insulation is disposed in the insulation space, the fasteners preventing insulation from entering the refrigerated space.

It is a feature of the invention that each fastener includes a conical depression in the head, the depression terminating at a thinwall between the depression and a bore in the tubular locking element.

It is a feature of the invention to provide an elongate shelf ladder and a plurality of screws fastening the ladder to the liner, each screw being received in the conical depression of one of the fasteners and piercing the thinwall so that the screw is secured to the fastener.

It is another feature of the invention that the locking element gradually narrows from the select position to a distal end to facilitate insertion of the fastener in the openings.

It is a further feature of the invention that each fastener is of molded plastic construction.

There is disclosed in accordance with another aspect of the invention a refrigeration apparatus cabinet comprising an outer shell including walls defining a front opening. A plastic liner in the shell provides an insulation space therebetween and has connected rear and side walls to define a refrigerated space accessible through the shell front opening. The liner includes a plurality of openings through one of the walls. A plurality of fasteners are provided, one for each liner opening. Each fastener comprises a head larger than the liner opening disposed in the refrigerated space and a tubular locking element extending rearwardly from the head, the locking element having an outer surface having an outer diameter less than the liner opening at its connection to the head and an outer diameter at a select position greater than that of the liner opening, the select position being spaced a distance from the head corresponding to a thickness of the liner. A locking element extends through each liner opening so that the liner is sandwiched between the head and the select position to hold the fastener on the liner. A body of in situ foam insulation is disposed in the insulation space, the fasteners preventing insulation from entering the refrigerated space.

There is disclosed in accordance with still another aspect of the invention a refrigeration apparatus cabinet comprising an outer shell including walls defining a front opening. A plastic liner in the shell provides an insulation space therebetween and has connected rear and sidewalls to define a refrigerated space accessible through the shelf front opening. The liner includes a plurality of vertically spaced, aligned openings through one of the walls. An elongate reinforcement bar has a plurality of spaced, aligned openings, similar to the liner openings, the reinforcement bar being disposed behind the liner in the insulation space with each liner opening aligned with a reinforcement bar opening. A plurality of fasteners are provided, one for each liner opening. Each fastener comprises a head larger than the liner opening disposed within the refrigerated space and a tubular locking element extending rearwardly from the head, the locking element having an outer surface having an outer diameter less than the liner opening at its connection to the head and an outer diameter at a select position greater than that of the reinforcement bar openings, the select position being spaced a distance from the head corresponding to a combined thickness of the liner and the reinforcement bar. A locking element extends through each liner opening and the associated reinforcement bar opening so that the liner and reinforcement bar are sandwiched between the head and a select position to fasten the reinforcement bar to the liner. A body of in situ foam insulation is disposed in the insulation space, the fasteners preventing insulation from entering the refrigerated space.

There is disclosed in accordance with a further aspect of the invention a method of assembling a refrigeration apparatus cabinet. The method comprises the steps of providing an outer shell including walls defining a front opening; providing a plastic liner having connected rear and side walls to define a refrigerated space, the liner including a plurality of rows of vertically spaced, aligned openings through the rear wall; positioning an elongate reinforcement bar behind the liner rear wall in alignment with each row of liner openings, each reinforcement bar having a plurality of spaced, aligned openings each aligned with a liner opening; fastening each reinforcement bar to the liner using a fastener for each liner opening, each fastener comprising an enlarged head and a tubular locking element extending rearwardly from the head, the locking element having an outer surface having an outer diameter less than the liner opening at its connection to the head and an outer diameter at a select position greater than that of the reinforcement bar openings, the select position being spaced a distance from the head corresponding to a combined thickness of the liner and the reinforcement bar, the locking element being inserted through a liner opening and the associated reinforcement bar opening to provide a snap fit connection with the liner and reinforcement bar sandwiched between the head and the select position to fasten the reinforcement bar to the liner; positioning the liner in the shell to define an insulation space therebetween; and depositing a body of in situ foam insulation in the insulation space, the fasteners preventing insulation from entering the refrigerated space.

Thus, in accordance with the invention, a fastener is designed to allow a refrigerator cabinet to be assembled and foam insulated without shelf ladders installed. The fastener also secures a reinforcement bar in the foam insulation behind the liner, the reinforcement bar supporting shelf ladders which might later be installed in the cabinet as by fastening the shelf ladders to the fasteners.

Further features and advantages of the invention will readily be apparent from the specification and from the drawing.

DETAILED DESCRIPTION OF THE INVENTION

Figure 1:
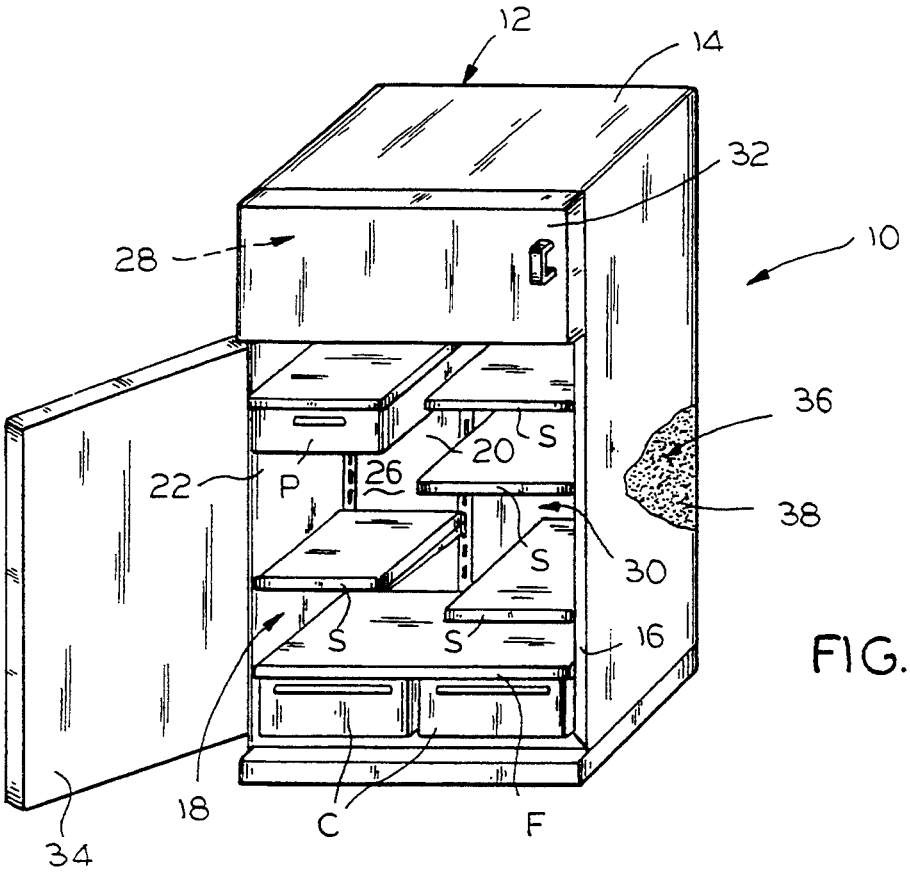
FIG. 1 is a perspective view of a refrigerator cabinet using a refrigerator shelf ladder fastener according to the invention.

With reference to FIG. 1, a refrigeration apparatus, such as a refrigerator/freezer, 10 uses a shelf ladder fastener according to the invention. The invention is shown utilized with a top mount freezer; however, the shelf ladder fastener may be used in conjunction with other types of refrigeration apparatus, as will be obvious to those skilled in the art.

Figure 2:
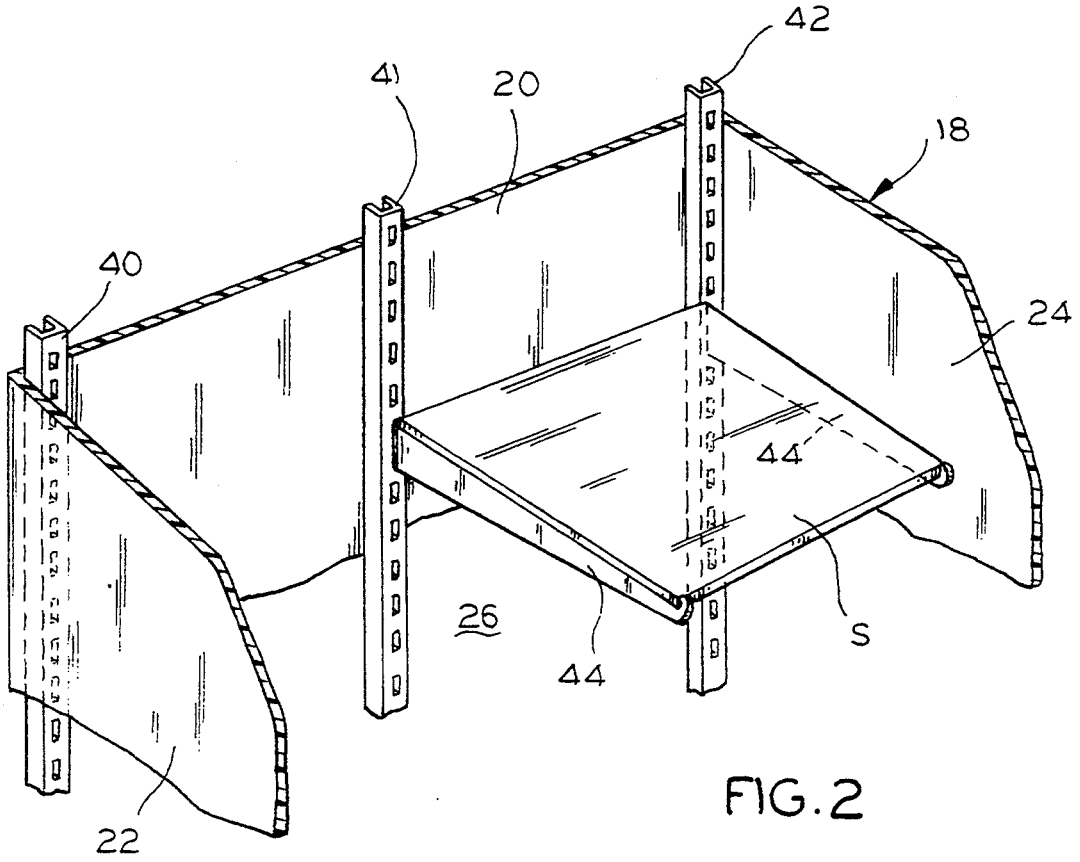
FIG. 2 is a partial sectional view illustrating a shelf and ladder mount system for the refrigerator of FIG. 1.

The refrigerator/freezer 10 includes a cabinet 12 having an outer, metal shell 14 having walls defining a front opening 16. A tub-shaped liner 18 molded of plastic, such as ABS plastic, includes connected rear wall 20 and opposite side walls 22 and 24, see also FIG. 2, to define a refrigerated space 26. Although not shown, in the illustrated refrigerator/freezer 10, a divider or partition wall is suitably secured to the liner 18 to divide the refrigerated space 26 into a below-freezing, or freezer, compartment 28 and an above-freezing, or fresh food, compartment, 30. A freezer door 32 and a fresh food door 34 are hingedly mounted to the shell 14 at the front opening 16 for providing selective access to the freezer and fresh food compartments 28 and 30, respectively.

The liner 18 is disposed within and spaced inwardly from the outer shell 14 to provide an insulation space 36 therebetween. The insulation space 36 is filled with a body of in situ foam insulation 38 which is foamed in place during the assembly process.

The freezer and fresh food compartments 28 and 30 are cooled by circulating air therethrough which has been refrigerated as a result of being passed in heat exchange relation with a conventional refrigeration system.

As is conventional with a refrigerator/freezer 10, maximum use is made of the refrigerated space 26. This is done by sub-dividing the compartments 28 and 30 using various storage systems. Such storage systems can take many known forms and may consist of shelves S and storage pans P. Also provided are crisper pans C, generally positioned below a fixed bottom shelf F. Typically, the shelves S and pans P are cantilevered and vertically adjustable within the fresh food compartment 30. To provide vertical adjustability, three vertical shelf standards 40, 41 and 42 are mounted to the liner rear wall 20 laterally spaced relative to one another. Particularly, the first shelf ladder 40 is mounted to the rear wall 20 proximate the left side wall 22, the second shelf ladder 41 is centrally positioned along the liner rear wall 20 and the third shelf ladder 42 is mounted to the liner rear wall 20 proximate the right side wall 24. The ladders 40, 41 and 42 are used to mount conventional cantilevered shelves S or pans P at any select vertical height within the compartment 26. Particularly, each shelf S includes side brackets 44, see FIG. 2, including suitable hooks for fastening to the ladders 40, 41 and 42, as is well known.

The present invention is concerned particularly with fasteners used for fastening the shelf ladders 40–42 to the liner rear wall 20. Although in the illustrated embodiment three shelf ladders 40–42 are used, all fastened to the liner rear wall 20, a different number of ladders could be used and could be fastened to any of the liner walls, including those not specifically shown herein.

Figure 3:
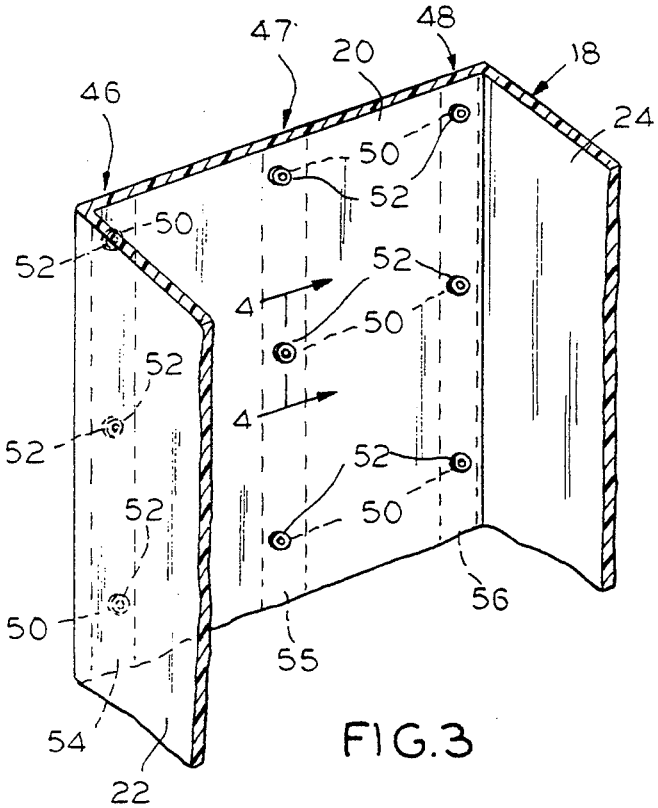
FIG. 3 is a view similar to that of FIG. 2 prior to installation of the shelf ladders.
Figure 4:
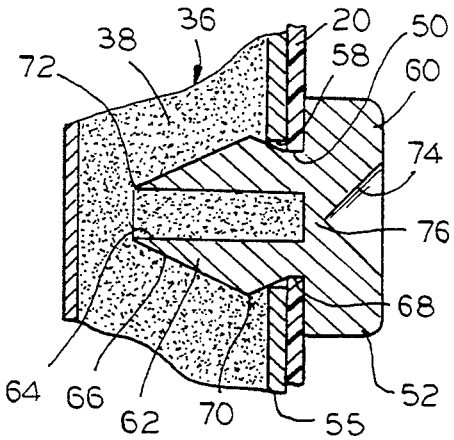
FIG. 4 is a sectional view taken along the line 4—4 of FIG. 3.

With reference to FIGS. 3 and 4, the liner rear wall 20 includes three rows 46, 47 and 48 of vertically spaced, aligned openings 50. Fastened within each opening 50 is a shelf ladder fastener 52 according to the invention. Particularly, the fastener 52 covers each opening 50 and also fastens a reinforcement behind each opening 50. In the illustrated embodiment, the reinforcement comprises three elongate reinforcement bars 54, 55 and 56, one for each of the respective rows 46, 47 and 48 of openings 50. Each reinforcement bar 54–56 comprises an elongate plate having a plurality of openings 58, see FIG. 4. In the illustrated embodiment, the openings 58 are slightly larger than the liner openings 50 and are aligned and vertically spaced similar to the liner openings 50. Each reinforcement bar 54–56 is placed between the liner rear wall 20 in alignment with the respective rows 46–48 of openings 50, with each of the liner openings 50 being aligned with a reinforcement opening 58, see FIG. 4.

With reference to FIG. 4, each fastener 52 is of molded plastic construction and comprises an enlarged round or pan head 60 of a size larger than the liner opening 50. A tubular locking element 62 is connected to and extends rearwardly from the head 60. The locking element 62 is generally tubular including a central bore 64 and an outer surface 66. The outer surface 66 is generally cylindrical at a connecting portion 68 connected to the head 60. The connecting portion 68 has an outer diameter slightly less than the diameter of the liner opening 50 and also the reinforcement bar opening 58. The outer surface 66 is inclined and gradually widens to a select peak position 70. The outer diameter at the select peak position 70 is greater than the diameter of the reinforcement bar opening 58. The select position is spaced from the head 60 a distance greater than the combined thickness of the reinforcement bar 55 and the liner rear wall 20. The outer surface 66 is then inclined to a distal end 72 having an outer diameter less than the diameter of both the liner opening 50 and reinforcement bar opening 58. The head 60 includes an outwardly opening conical depression 74 terminating at a relatively thinwall 76 between the depression 74 and the locking element bore 64.

To fasten the reinforcement bar 55 to the finer rear wall 20, the reinforcement bar is positioned as discussed above. A fastener 52 is inserted through each finer opening 50 and corresponding aligned reinforcement bar opening 58. Particularly, the locking element narrow end 72 is inserted first through the liner opening 58. The incline between the distal end 72 and peak 70 aids in insertion with some relative deformation being provided the further it is inserted until the peak 70 is forced inwardly so that it extends into the insulation space 36. As a result, the liner rear wall 20 and the reinforcement bar 55 are sandwiched between the fastener head 60 and the locking element peak 70 to provide a snap fit connection to fasten the reinforcement bar 55 to the liner rear wall 20.

A fastener 52 is fastened through each liner opening 50 to fasten the three reinforcement bars 54–64 to the liner rear wall 20. The body of in situ foam insulation 38 is then deposited in the insulation space. The fastener 52 completely fills the liner opening 50 to prevent insulation from entering from the insulation space 36 into the refrigerated space 26. At this point in the assembly process, the liner is provided with each opening 50 covered by a fastener 52. The refrigerator/freezer 10 could then be produced with shelf ladders 54–56, without shelf ladders, or with some other method of shelf installation.

Figure 4A:
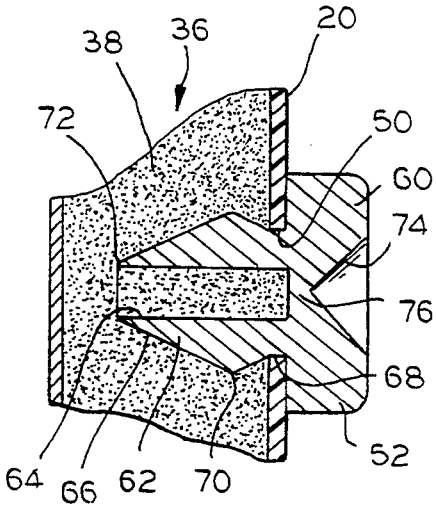
FIG. 4A is a sectional view similar to that of FIG. 4 in an application not requiring use of a fastener reinforcement.

With reference to FIG. 4A, a fastener 52 is shown fastened to the liner 20 without the reinforcement bar 55. Particularly, the locking element narrow end 72 is inserted through the liner opening 58. The incline between the distal end 72 and peak 70 aids in insertion with some relative deformation being provided the further it is inserted until the peak 70 is forced inwardly so that it extends into the insulation space 36. As a result, the liner rear wall 20 is sandwiched between the fastener head 60 and the locking element peak 70 to provide a snap fit connection. The fastener 52 is used without a reinforcement bar 55, for example, to provide mounting points on the liner 18 for mounting structures other than shelf ladders.

Figure 5:
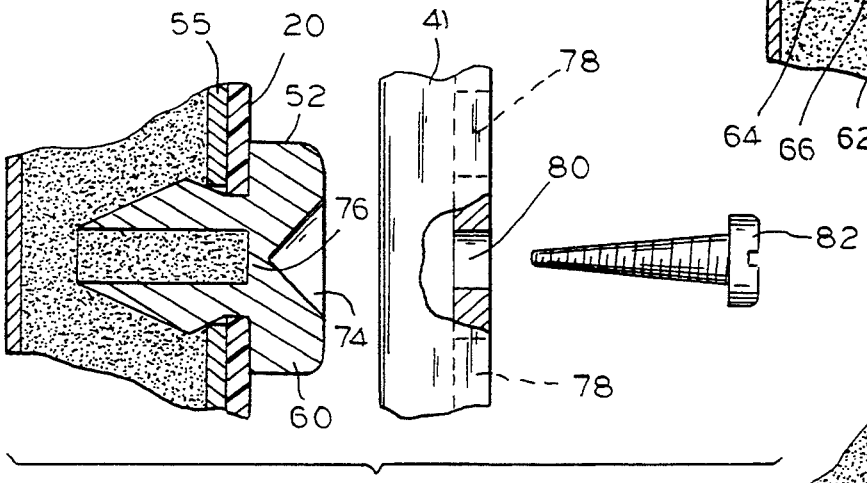
FIG. 5 is a partial exploded view similar to FIG. 4 and further illustrating a procedure for fastening a ladder in the refrigerator cabinet.
Figure 6:
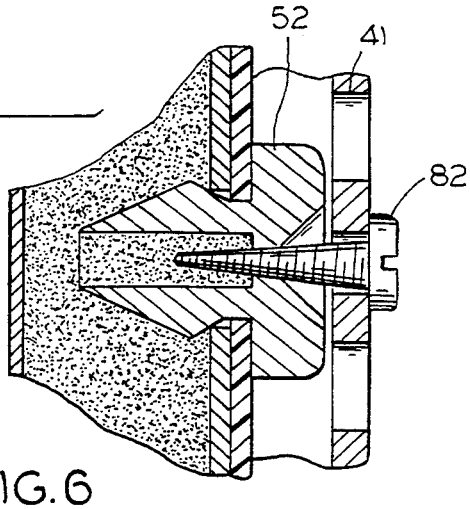
FIG. 6 is a sectional view similar to that of FIG. 5 showing the installed shelf ladder.

In refrigerator/freezers 10 in which shelf ladders are used, the shelf ladder 41 is positioned vertically in alignment with the row 47, see FIG. 5. The ladder 41 in addition to including a plurality of longitudinally spaced vertical slots 78 includes circular openings 80 for receiving screws 82. The screw 82 is inserted through the opening 80 and then into the fastener conical depression 74 where it is inwardly centrally directed owing to the conical design of the depression 74. The screw 82 is then turned in a conventional manner to pierce the thinwall 76 and then extend into the locking element bore (>4, as shown in FIG. 6. Thus, the screw 82 fastens the shelf ladder 41 via the fasteners 52 to the liner rear wall 20. The shelf ladders are supported by the reinforcement bar 55. Also, the screw 82 acts as a screw anchor in the reinforcement bar 55. The fastener head 60 being of a size smaller than the ladder 41 is completely concealed so that it is not evident. Alternatively, the fastener head 60 could be sized to allow the shelf ladder 41 to sit directly on top of the fastener and perform the function of a conventional shelf ladder spacer.

Thus, the fastener 52 performs multiple functions in the refrigerator/freezer 10. If a refrigerator/freezer 10 is to use no shelf ladders, then the liner 18 is sealed by the fasteners 52. The fasteners 52 act as appearance hole plugs with no additional manufacturing steps or parts required. If shelf ladders 40–42 are to be installed, then the retaining screws 82 pass through the shelf ladders 40–42 and are driven into the conical depression 74 in the head 60, through the thinwall 76 and into the bore 64 to act as a screw anchor in the reinforcement bar. Finally, the fasteners 52 are operable to fasten the reinforcement bars 54–56 to the liner rear wall and maintain them in alignment with the rows 46–48 of openings 50 during the foaming process.

The foregoing disclosure of the invention is illustrative of the broad inventive concepts comprehended by the invention.

I claim:

1. A refrigeration apparatus cabinet, comprising:

an outer shell including walls defining a front opening;

a plastic liner in said shell providing an insulation space therebetween and having connected rear and side walls to define a refrigerated space accessible through said shell front opening, said liner including a plurality of openings through one of said walls;

a reinforcement, one for each liner opening, comprising a plate having an opening, similar to the liner opening, said reinforcement being disposed behind the liner in said insulation space aligned with a liner opening;

a plurality of fasteners, one for each liner opening, each said fastener comprising a head larger than the liner opening disposed in said refrigerated space and a tubular locking element extending rearwardly from said head, said locking element having an outer surface having an outer diameter less than said liner opening at its connection to the head and an outer diameter at a select position greater than that of the reinforcement opening, the select position being spaced a distance from said head corresponding to a combined thickness of the liner and the reinforcement, a locking element extending through each liner opening and the associated reinforcement opening so that said finer and reinforcement are sandwiched between the head and the select position to fasten the reinforcement to the liner; and a body of in situ foam insulation disposed in said insulation space, said fasteners preventing insulation from entering said refrigerated space.

2. The refrigeration apparatus cabinet of claim 1 wherein each said fastener includes a conical depression in said head, said depression terminating at a thinwall between said depression and a duct in said tubular locking element.

3. The refrigeration apparatus cabinet of claim 2 further comprising an elongate shelf ladder and a plurality of screws fastening the ladder to said liner, each said screw being received in the conical depression of one of said fasteners and piercing said thinwall so that the screw is secured to the fastener.

4. The refrigeration apparatus cabinet of claim 1 wherein the locking element gradually narrows from said select position to a distal end to facilitate insertion of the fastener in said openings.

5. The refrigeration apparatus cabinet of claim 1 wherein each said fastener is of molded plastic construction.

6. A refrigeration apparatus cabinet, comprising:

an outer shell including walls defining a front opening;

a plastic liner in said shell providing an insulation space therebetween and having connected rear and side walls to define a refrigerated space accessible through said shell front opening, said liner including a plurality of vertically spaced, aligned openings through one of said walls;

an elongate reinforcement bar having a plurality of spaced, aligned openings, similar to the liner openings, said reinforcement bar being disposed behind the liner in said insulation space with each liner opening aligned with a reinforcement bar opening;

a plurality of fasteners, one for each liner opening, each said fastener comprising a head larger than the liner opening disposed in said refrigerated space and a tubular locking element extending rearwardly from said head, said locking element having an outer surface having an outer diameter less than said liner opening at its connection to the head and an outer diameter at a select position greater than that of the reinforcement bar openings, the select position being spaced a distance from said head corresponding to a combined thickness of the liner and the reinforcement bar, a locking element extending through each liner opening and the associated reinforcement bar opening so that said liner and reinforcement bar are sandwiched between the head and the select position to fasten the reinforcement bar to the liner; and a body of in situ foam insulation disposed in said insulation space, said fasteners preventing insulation from entering said refrigerated space.

7. The refrigeration apparatus cabinet of claim 6 wherein each said fastener includes a conical depression in said head, said depression terminating at a thinwall between said depression and a duct in said tubular locking element.

8. The refrigeration apparatus cabinet of claim 7 further comprising an elongate shelf ladder and a plurality of screws fastening the ladder to said liner, each said screw being received in the conical depression of one of said fasteners and piercing said thinwall so that the screw is secured to the fastener.

9. The refrigeration apparatus cabinet of claim 6 wherein the locking element gradually narrows from said select position to a distal end to facilitate insertion of the fastener in said openings.

10. The refrigeration apparatus cabinet of claim 6 wherein each said fastener is of molded plastic construction.

11. A method of assembling a refrigeration apparatus cabinet, comprising the steps of:

providing an outer shell including walls defining a front opening;

providing a plastic liner having connected rear and side walls to define a refrigerated space, said liner including a plurality of rows of vertically spaced, aligned openings through said rear wall;

positioning an elongate reinforcement bar behind the liner rear wall in alignment with each row of liner openings, each reinforcement bar having a plurality of spaced, aligned openings each aligned with a liner opening;

fastening each reinforcement bar to the liner using a fastener for each liner opening, each said fastener comprising an enlarged head and a tubular locking element extending rearwardly from said head, said locking element having an outer surface having an outer diameter less than said liner opening at its connection to the head and an outer diameter at a select position greater than that of the reinforcement bar openings, the select position being spaced a distance from said head corresponding to a combined thickness of the liner and the reinforcement bar, the locking element being inserted through a liner opening and the associated reinforcement bar opening to provide a snap fit connection with the liner and reinforcement bar sandwiched between the head and the select position to fasten the reinforcement bar to the liner;

positioning the liner in the shell to define an insulation space therebetween; and depositing a body of in situ foam insulation in said insulation space, said fasteners preventing insulation from entering said refrigerated space.

12. The method of claim 11 wherein said fastening step comprises using a fastener including a conical depression in said head, said depression terminating at a thinwall between said depression and a duct in said tubular locking element.

13. The method of claim 12 further comprising the step securing an elongate shelf ladder to said liner using a plurality of screws, each said screw being received in the conical depression of one of said fasteners and piercing said thinwall so that the screw is secured to the fastener.

14. The method of claim 11 wherein said fastening step comprises using a fastener wherein the locking element gradually narrows from said select position to a distal end to facilitate insertion of the fastener in said openings.

15. A refrigeration apparatus cabinet, comprising:

an outer shell including walls defining a front opening;

a plastic liner in said shell providing an insulation space therebetween and having connected rear and side walls to define a refrigerated space accessible through said shell front opening, said liner including a plurality of openings through one of said walls;

a plurality of fasteners, one for each liner opening, each said fastener comprising a head larger than the liner opening disposed in said refrigerated space and a tubular locking element extending rearwardly from said head, said locking element having an outer surface having an outer diameter less than said liner opening at its connection to the head and an outer diameter at a select position greater than that of the liner opening, the select position being spaced a distance from said head corresponding to a thickness of the liner, a locking element extending through each liner opening so that said liner is sandwiched between the head and the select position to connect the fastener to the liner; and a body of in situ foam insulation disposed in said insulation space, said fasteners preventing insulation from entering said refrigerated space.

16. The refrigeration apparatus cabinet of claim 15 wherein each said fastener includes a conical depression in said head, said depression terminating at a thinwall between said depression and a duct in said tubular locking element.

17. The refrigeration apparatus cabinet of claim 16 further comprising a refrigerator structure and a screw fastening the structure to said liner, said screw being received in the conical depression of one of said fasteners and piercing said thinwall so that the screw is secured to the fastener.

18. The refrigeration apparatus cabinet of claim 15 wherein the locking element gradually narrows from said select position to a distal end to facilitate insertion of the fastener in said openings.

19. The refrigeration apparatus cabinet of claim 15 wherein each said fastener is of molded plastic construction.

* * * * *